US005621993A

United States Patent [19]

Stover

[11] Patent Number: 5,621,993

[45] Date of Patent: Apr. 22, 1997

[54] NUMERIC INDICIA BLANK FOR FORMING SIGNS

[76] Inventor: Carl Stover, 222 Stover Dr., Delaware, Ohio 43015

[21] Appl. No.: 547,312

[22] Filed: Oct. 24, 1995

[51] Int. Cl.[6] ..... G09F 7/04

[52] U.S. Cl. ..... 40/638; 40/600

[58] Field of Search ..... 40/638, 595, 600

[56] References Cited

U.S. PATENT DOCUMENTS

| | | | |
|---|---|---|---|
| 2,426,079 | 8/1947 | Bliss . | |
| 3,226,862 | 1/1966 | Gabruk | 40/638 |
| 3,294,611 | 12/1966 | Vomela . | |
| 3,315,387 | 4/1967 | Heuser . | |
| 3,338,395 | 8/1967 | Silverstein . | |
| 3,402,498 | 9/1968 | Fishback . | |
| 3,831,303 | 8/1974 | Funaki . | |
| 3,837,102 | 9/1974 | Golay . | |
| 3,914,483 | 10/1975 | Stipek, Jr. | 40/638 X |
| 4,125,658 | 11/1978 | Miles . | |
| 4,216,599 | 8/1980 | Eckert . | |
| 4,344,994 | 8/1982 | Batty et al. | 40/595 X |
| 4,366,637 | 1/1983 | Deckamps | 40/600 X |
| 4,496,945 | 1/1985 | Stadjuhar et al. | 40/450 X |
| 4,507,888 | 4/1985 | Robinson et al. | 40/600 X |
| 4,539,768 | 9/1985 | Halliday | 40/447 |
| 4,587,753 | 5/1986 | Harper | 40/451 |
| 4,729,184 | 3/1988 | Cihanek | 40/450 |
| 4,821,439 | 4/1989 | Wilck | 40/638 |
| 5,303,489 | 4/1994 | Blegen | 40/600 X |

*Primary Examiner*—Joanne Silbermann
*Attorney, Agent, or Firm*—Richard C. Litman

[57] ABSTRACT

A sheet material blank preformed to a standardized dimension and configuration for forming the digits zero through nine for signs. The preferred embodiment of the blank is made from an opaque, flexible sheet material having pressure sensitive adhesive applied to the backside and a release liner. The key feature of the blank is its rectangular outer dimension and two rectangular apertures of equal area centered within said outer dimension so as to define a pair of elongated legs of equal width integrally bridged by three horizontal elongated members of a width equal to the width of said pair of legs. The blank thus defines a figure having parallel and linear edges resembling the digit eight. The second key feature of the blank is linear indicia provided on the release liner which aids the consumer in creating the desired digits from the blank. Predetermined rectangular areas are designated on each of the elongated legs and elongated horizontal members whereby a rectangular area may be selectively removed by making a cut along a pair of the linear indicia to form a digit different from the blank. Alternately, the rectangular outer dimensions and the rectangular apertures can have round corners.

16 Claims, 2 Drawing Sheets

NUMERIC INDICIA BLANK FOR FORMING SIGNS

BACKGROUND OF THE INVENTION

1. Field of the Invention

The present invention relates to a sheet material blank of standardized dimension and configuration for forming the digits zero through nine for signs.

2. Description of the Prior Art

The general concept of providing numeric indicia on an adhesive backing is known in the prior art. Commonly known as "peel and stick" labels, alphanumeric labels are commercially and commonly available to the consumer for labeling signs, usually used for quick and easy numbering of a house or mailbox. Although each of these labels address this general purpose, many disadvantages are associated with the presently known labels which are readily apparent in the following hypothetical situations.

A hypothetical consumer has a need for the house number "15311" and travels to a neighborhood hardware store to choose from the available sign labels. The consumer only needs three "ones", a "five" and a "three". However, one choice might include a kit containing the numerals zero through nine, hence requiring the consumer to not only buy unnecessary numerals, but also to buy three times the unnecessary numerals. A second and preferred choice might include individual numerals, from which he can choose from individual "ones", "fives" and "threes". However inevitably, "one" being a common house number, the retailer has failed to stock sufficient "ones" for our consumer and other numbering styles do not match the "ones". Hence, the now frustrated consumer returns home and places an order with a custom sign manufacturer. Although the sign manufacturer has sufficient stock, the sign must be prepared to custom order, requiring the consumer to rely on an unseen product, to convey the appropriate information regarding the consumer's house number digits to the manufacturer, and bear an increased cost uncompetitive with mass produced labels.

The present invention addresses and solves each of these problems and, moreover, addresses a new problem which has uniquely arisen due to the prevalence of home shopping using remote telecommunication devices. Our hypothetical consumer also now demands the convenience and time-savings of ordering items seen on television. Therefore, a special need now exists for a means by which, when the consumer orders a numbered sign using the manufacturer's numerals from the home shopping club, all possible combinations of numerals for the sign can be economically and competitively provided, eliminating the need to place a custom order with a remote manufacturer and reducing manufacturing costs.

The common failure in the prior art among all indicia indicating means using sheet materials and a preprinted indicia is that no means is provided for changing the indicia to address the above noted problems and needs. For example, U.S. Pat. No. 3,294,611 issued Dec. 27, 1966 to Vomela describes predetermined alphanumeric characters which are placed upon rectangular mounting sheets so that, by placing these mounting sheets in side by side relation, the characters are properly aligned and spaced. By removing a release liner covering a pressure sensitive adhesive, the predetermined number can be positioned and adhered to a flat surface. U.S. Pat. No. 3,315,387 issued Apr. 25, 1967 to Heuser describes a similar rectangular labels with a structural alignment means using V-shaped notches. U.S. Pat. No. 4,344,994 issued Aug. 17, 1982 to Batty et al. describes adhesive rectangular labels with a structural alignment means using stepped-notches at the corner of each tile. U.S. Pat. No. 3,402,495 issued Sep. 24, 1968 to Fishback describes alphanumeric characters pressure bonded to a surface of a slanted parallelogram in shape. U.S. Pat. No. 3,338,395 issued Aug. 29, 1967 to Silverstein shows a sign-making kit including preprinted pads of bound, adhesive-coated sheets all of the same rectangular shape and having specially spaced relationships between the preprinted indicia for proper alignment on a backboard. None of these inventions provide means by which a single mass produced numeral can provide all possible number combinations necessary for a sign, thereby eliminating the need of the manufacturer to anticipate the volume of numerals needed in a particular application.

A stenciling device using geometric shapes to align characters is described in U.S. Pat. No. 4,125,658 issued Nov. 14, 1978 to Miles. Although stencilling allows a consumer to infinitely reproduce a number, the skills and materials required for stencilling are substantial and defeat the purpose of providing "peel and stick" labels.

Also noted in non-analogous art regarding electrically controlled indicators and digital display devices is the general concept of building and disassembling sections to form numbers. For example, U.S. Pat. No. 2,426,079 issued Jun. 19, 1944 to Bliss describes an assembly for a lighted sign, having a foreground defining apertures forming a rectangular eight-like configuration, and a contrasting background revealed through the apertures. Various apertures are then selectively masked by a shutter to form a different digit. U.S. Pat. No. 4,496,945 issued Jan. 29, 1985 to Stadjuhar et al. describes a display device also using shutter panels attached to cams. U.S. Pat. No. 4,539,768 issued Sep. 10, 1985 to Halliday and U.S. Pat. No. 4,729,184 issued Mar. 8, 1988 to Cihaneck both describe digital display apparatus using pivoted flaps manually moved.

Besides mechanically moved shuttering devices, digital displays have formed numbers using other means. U.S. Pat. No. 3,831,303 issued Aug. 27, 1974 to Funaki describes a device indicating symbols formed by overlapping slits and patterns on a drum. U.S. Pat. No. 3,837,102 issued Sep. 24, 1974 to Golay describes a device utilizing at least one pair of grids, each grid having a plurality of lines and piezoelectric means for moving the grids one relative to another to effect the display and disappearance of numeric indicia. U.S. Pat. No. 4,216,599 issued Aug. 12, 1980 to Eckert describes an indicia display device using a opaque front plate with light permeable spots. U.S. Pat. No. 4,587,753 issued May 13, 1986 to Harper describes a house number indicating device using backlighted screens having a die stamped stylized "8" with a "1 superimposed down the middle of the 8".

None of the above inventions and patents, taken either singly or in combination, is seen to describe the instant invention as claimed.

SUMMARY OF THE INVENTION

The present invention relates to a blank of sheet material preformed to a standardized dimension and configuration for forming the digits zero through nine for application to signs. The preferred embodiment of the blank is made from an opaque, flexible sheet material having pressure sensitive adhesive applied to the backside and a release liner. The key feature of the blank is its rectangular outer dimension and two rectangular apertures of equal area centered within said outer dimension so as to define a pair of elongated legs of equal width integrally bridged by three horizontal elongated members of a width equal to the width of said pair of legs. The blank thus defines a figure having parallel and linear edges resembling the digit eight. The second key feature of the blank is linear indicia provided on the release liner which aids the consumer in creating the desired digits from the blank. Predetermined rectangular areas are designated on each of the elongated legs and elongated horizontal members, whereby a rectangular area may be selectively removed by making a cut along a pair of the linear indicia to form a digit different from the blank.

The preferred embodiment is directed at the ordinary consumer, wherein the blank is manufactured from any thin sheet material easily cut by a sharp knife or scissors, such as vinyl or the like plastic, rubber, aluminum, and other similar water resistant sheet materials. However, the dimensions and configuration of the blank is specifically directed to saving a manufacturer of standardized signs the cost of having to include unnecessary materials for all possible combinations of numerals, otherwise raising the cost of the sign to both the consumer and manufacturer.

Accordingly, it is a principal object of the invention to provide a single preformed sheet material blank for making digits zero through nine for standardized signs.

It is another object of the invention to provide a sheet material blank which can be easily cut to remove a rectangular portion of the sheet material blank to create digits zero through nine.

It is a further object of the invention to provide an adhesive coated sheet material blank dimensioned and configured to resemble a rectangular eight, saving a manufacturer of standardized signs the cost of having to include unnecessary materials for all possible combinations of numerals commonly used for house numbers.

Still another object of the invention is to provide an adhesive coated sheet material blank having release liners providing printed indicia to guide a user in removing the appropriate rectangular portion of the sheet material blank to create the digits zero through nine for signs.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT(S)

Figure 2:
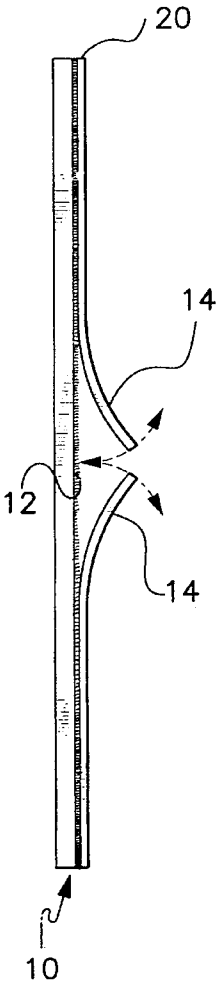
FIG. 2 is a side view of the configuration of the preformed sheet material blank with the layers enlarged for clarity.
Figure 1:
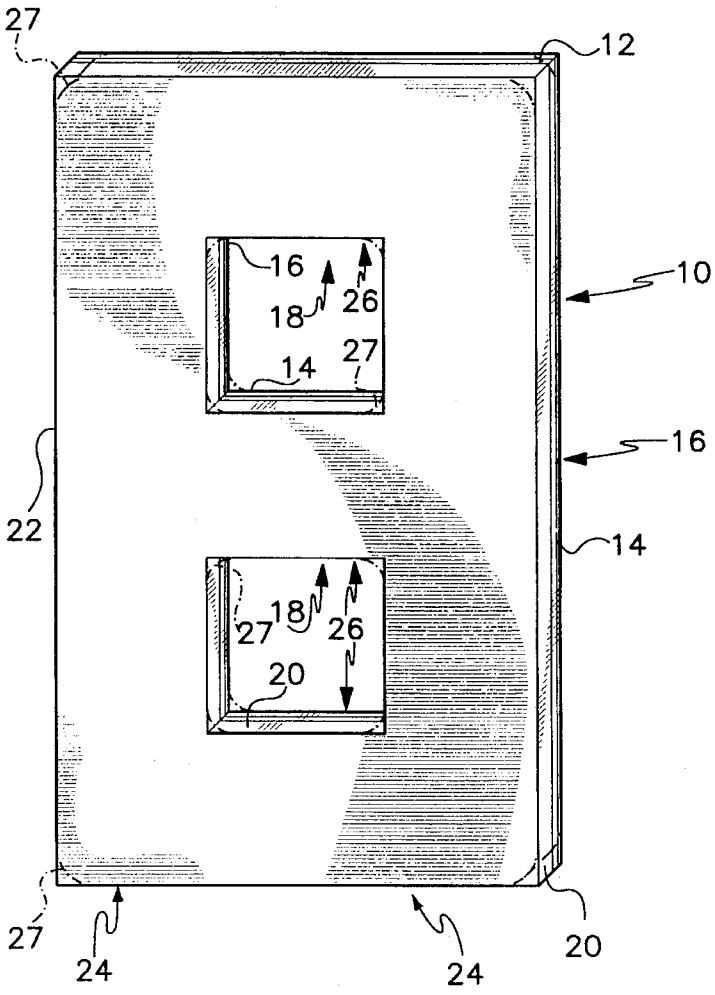
FIG. 1 is a perspective view of the configuration of the preformed blank with layers of a sheet material, a release liner and an adhesive enlarged for clarity.

The present invention relates to a sheet material blank preformed to a standardized dimension and configuration for forming the digits zero through nine for signs. Referring to FIG. 1, the blank 10 can be seen having three layers: a sheet material 20, an adhesive 12 and a release liner 14. As can be best appreciated from FIG. 2, the release liner 14 is divided by a cut line 16 into two removable pieces to accommodate manual removal of the release liner 14. Removal of the release liner 14 reveals the adhesive 12, preferably pressure sensitive, for affixing the sheet material 20 to a substrate. The sheet material 20 may be opaque, reflective, or made of any material suitable for use with signage applications. Typically, such materials would include any thin sheet material easily cut by a sharp knife or scissors, such as vinyl or the like plastic, rubber, aluminum, or other water resistant sheet materials. In the case of a magnetic sheet material, the adhesive layer is unnecessary.

The blank 10 is preformed to have a standardized dimension and configuration for forming the digits zero through nine for signs. The blank 10 is rectangular in outer dimension, shown by the peripheral line 22, and perforated by two rectangular apertures 18 of equal area centered within said outer dimension so as to define a pair of elongated legs 24 of equal width. The legs 24 are integrally bridged by three horizontal elongated members 26 of a width equal to the width of each of said legs 24. As referenced herein, the term "rectangular" is to be understood to mean to include any four sided parallelogram having four right angles. The blank thus defines a figure having parallel and linear edges resembling the digit eight. Alternatively, the rectangular outer dimensions and the rectangular apertures can have round corners, outside and inside, respectively, as shown in dashed lines 27 in FIG. 1.

Figure 3:
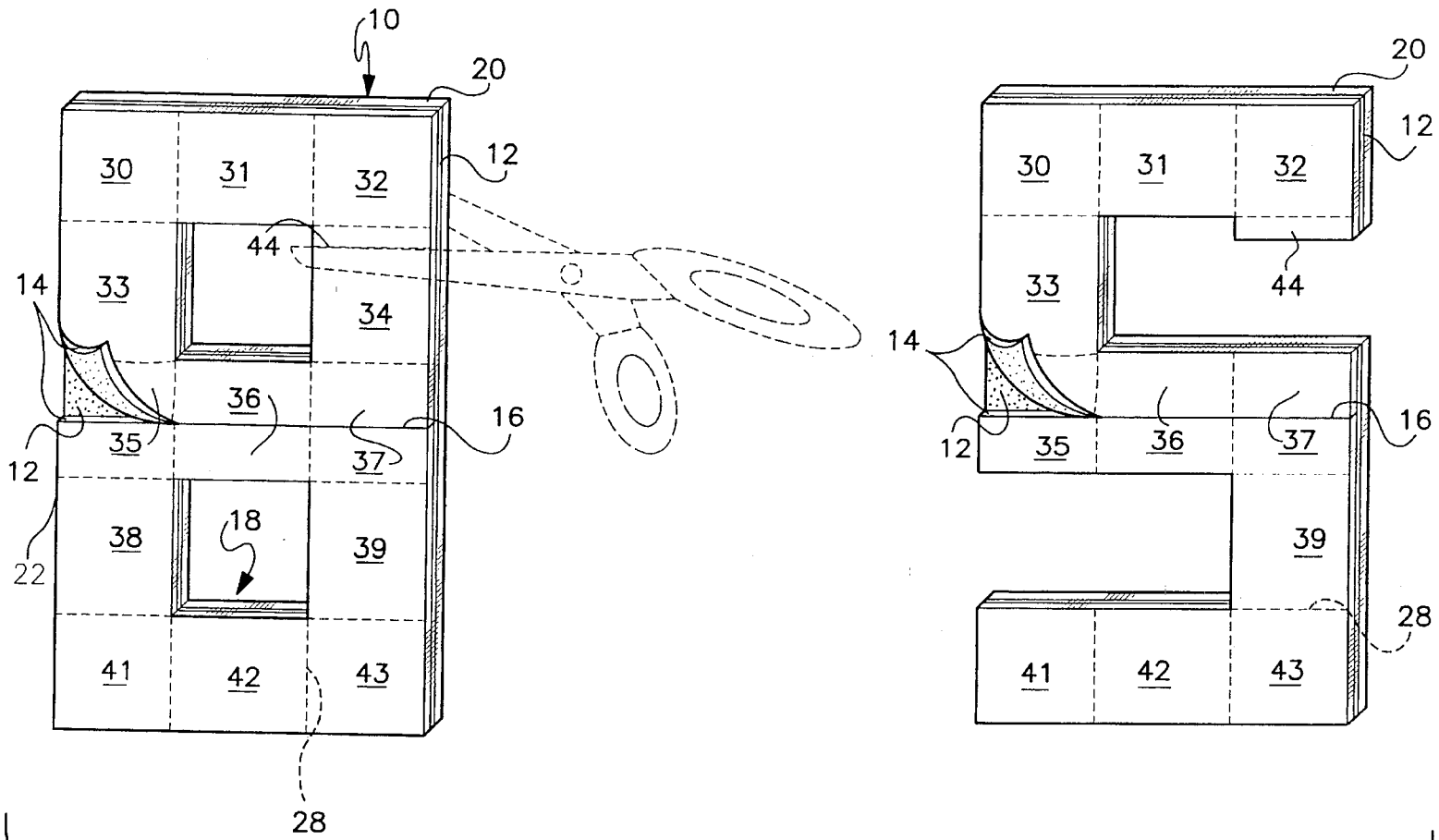
FIG. 3 is a rear view of the configuration of the preformed sheet material blank with printed linear indicia.

FIG. 3 is a view of the backside of blank 10 and clarifies its use. The release liner 14 is provided with linear indicia 28 to aid the consumer in creating the desired digits from the blank 10. Obviously, the preformed blank 10 can be used to represent the numeral "eight". However, a plurality of predetermined rectangular areas 30–39 and 41–44 are designated on each of the elongated legs 24 and elongated horizontal members 26, whereby a rectangular area may be selectively removed by making a cut, as suggested by the dashed scissors, along a pair of the linear indicia 28 to form a digit different from the blank. By removing the rectangular areas 34 and 38, a "two" can be formed, viewed in reverse as shown in FIG. 3.

Similarly, by cutting along the linear indicia bordering the same side of either of the sides of areas 31, 36 and 42, two "ones" can be formed. A "three" is formed by cutting along the linear indicia bordering areas 32 and 43 and between areas 36 and 37. A "four" is formed by cutting along both linear indicia of area 31 and along the indicia both between areas 42 and 41 and areas 39 and 37. A "five" is formed by cutting along both linear indicia of area 33 and area 39. A "six" is formed by cutting along both linear indicia of area 33. A "seven" is formed by cutting along the indicia between areas 44 and 34, between areas 35 and 36 and between areas 41 and 42. A "nine" is formed by cutting along the indicia between areas 41 and 42, between areas 39 and 43, and between areas 37 and 39. A "zero" is formed by removing area 36.

It is to be understood that the present invention is not limited to the sole embodiment described above, but encompasses any and all embodiments within the scope of the following claims.

I claim:

1. A preformed digit eight blank for forming numeric signs including digits from zero to seven and nine comprising:

an opaque, flexible sheet material, having a face, a backside and a rectangular outer dimension;

two rectangular apertures of equal area centered within said outer dimension so as to define a digit eight figure with a pair of elongated legs of equal width integrally bridged by three horizontal elongated members of a width equal to the width of said pair of legs;

a flexible magnetic layer attached to and conforming to said digit eight figure; and a flexible release liner layer applied to and conforming to said flexible magnetic layer, said release layer being provided with linear indicia defining edges of predetermined rectangular areas on said elongated legs and said elongated horizontal members, said linear indicia being arranged such that said rectangular areas can be selectively removed by cutting the magnetic layer and the sheet material along said linear indicia to form a digit from zero to seven and nine.

2. The preformed blank according to claim 1, wherein said face of said sheet material is reflective.

3. The preformed blank according to claim 1, wherein said rectangular outer dimension and said rectangular apertures each have round corners.

4. The preformed digit eight blank according to claim 1, wherein the opaque, flexible sheet material is plastic.

5. The preformed digit eight blank according to claim 4, wherein the plastic is vinyl.

6. The preformed digit eight blank according to claim 1, wherein the opaque, flexible sheet material is rubber.

7. The preformed digit eight blank according to claim 1, wherein the opaque, flexible sheet material is aluminum.

8. A preformed digit eight blank for forming numeric signs including digits from zero to seven and nine comprising:

an opaque, flexible sheet material, having a face, a backside and a rectangular outer dimension;

two rectangular apertures of equal area centered within said outer dimension so as to define a digit eight with a pair of elongated legs of equal width integrally bridged by three horizontal elongated members of a width equal to the width of said pair of legs;

a layer of pressure sensitive adhesive applied to said backside; and a release liner layer applied to said pressure sensitive adhesive layer, which release liner layer has linear indicia defining edges of predetermined rectangular areas on said elongated legs and said elongated horizontal members, said linear indicia being arranged such that said rectangular areas can be selectively removed by cutting the magnetic layer and the sheet material along said linear indicia to form a digit from zero to seven and nine.

9. The preformed blank according to claim 8, wherein said face of said sheet material is reflective.

10. The preformed digit eight blank according to claim 8, wherein said rectangular outer dimension and said rectangular apertures each have round corners.

11. The preformed digit eight blank according to claim 8, wherein the opaque, flexible sheet material is plastic.

12. The preformed digit eight blank according to claim 11, wherein the plastic is vinyl.

13. The preformed digit eight blank according to claim 8, wherein the opaque, flexible sheet material is rubber.

14. The preformed digit eight blank according to claim 8, wherein the opaque, flexible sheet material is aluminum.

15. A method of forming numeric signs from a preformed digit eight blank comprising:

providing an opaque, flexible sheet material selected from a group consisting of plastic, rubber and aluminum, having a face, a backside and a rectangular outer dimension;

applying a layer of pressure sensitive adhesive to said backside;

applying a release layer to said pressure sensitive adhesive layer with a pattern of linear indicia which defines a digit eight blank;

providing two rectangular apertures of equal area centered within said outer dimension so as to define the digit eight blank with a pair of elongated legs of equal width integrally bridged by three horizontal elongated members of a width equal to the width of said pair of legs; and selectively removing predetermined regions from the digit eight blank along the linear indicia to form a numeric sign from zero to seven and nine.

16. A method of forming magnetic numeric signs from a preformed digit eight blank comprising:

providing an opaque, flexible sheet material selected from a group consisting of plastic, rubber and aluminum, having a face, a backside and a rectangular outer dimension;

applying a magnetic layer to said backside;

applying a release layer to said magnetic layer with a pattern of linear indicia which defines a digit eight blank;

providing two rectangular apertures of equal area centered within said outer dimension so as to define the digit eight blank with a pair of elongated legs of equal width integrally bridged by three horizontal elongated members of a width equal to the width of said pair of legs; and selectively removing predetermined regions from the digit eight blank along the linear indicia to form a numeric sign from zero to seven and nine.

* * * * *